US005785534A

United States Patent [19]

Longueville et al.

[11] Patent Number: 5,785,534

[45] Date of Patent: Jul. 28, 1998

[54] ELECTRICAL CONNECTOR

[75] Inventors: Jacques Longueville, Oostkamp, Belgium; Peter Pagnin, Munich, Germany

[73] Assignee: Siemens Aktiengesellschaft, Munich, Germany

[21] Appl. No.: 625,635

[22] Filed: Mar. 29, 1996

[30] Foreign Application Priority Data

Mar. 29, 1995 [DE] Germany ..... 195 11 507.4

[51] Int. Cl.[6] ..... H01R 23/72

[52] U.S. Cl. ..... 439/65; 439/608; 439/931

[58] Field of Search ..... 439/608, 931, 439/101, 108, 65

[56] References Cited

U.S. PATENT DOCUMENTS

| | | | |
|---|---|---|---|
| 4,148,543 | 4/1979 | Shores | 439/608 |
| 4,451,107 | 5/1984 | Dola et al. | 439/608 |
| 4,780,095 | 10/1988 | Classon et al. | 439/637 |
| 5,104,341 | 4/1992 | Gilissen et al. | 439/608 |
| 5,174,770 | 12/1992 | Sasaki et al. | 439/108 |
| 5,178,549 | 1/1993 | Neumann et al. | 439/608 |
| 5,344,341 | 9/1994 | Yoshino | 439/931 |
| 5,362,247 | 11/1994 | Rodriguez | 439/931 |

FOREIGN PATENT DOCUMENTS

| | | |
|---|---|---|
| 0 377 984 | 7/1990 | European Pat. Off. . |
| 0 486 298 | 5/1992 | European Pat. Off. . |
| 0 562 427 | 9/1993 | European Pat. Off. . |
| 30 14 172 | 12/1983 | Germany . |
| 40 40 551 | 6/1991 | Germany . |
| 87/07441 | 12/1987 | WIPO . |

OTHER PUBLICATIONS

Publ. "Components 30/1992, No. 5" (Heilmann), pp. 189–192, Steckverbinder (Connectors).

Publ. "Markt & Technik–Wochenzeitung fuer Elektronik No. 26, Jun. 1994", pp. 36–37, Bauelemente (Components.

*Primary Examiner*—Gary F. Paumen

*Attorney, Agent, or Firm*—Herbert L. Lerner; Laurence A. Greenberg

[57] ABSTRACT

An electrical connector has contacting devices which establish electrical contact with contacting devices of external terminals. The contacting devices have contact faces formed thereon. The contact faces having a shape which enables substantially overlap-free connections with contact faces on the contacting devices of the external terminals. This reduces boundary planes which lead to signal reflection.

15 Claims, 3 Drawing Sheets

ELECTRICAL CONNECTOR

BACKGROUND OF THE INVENTION

1. Field of the Invention

The invention relates to electrical connectors of the type which have contacting devices for establishing an electrical contact with contacting devices of external terminals.

Such electrical connectors, usable for connecting printed circuit boards but also for connecting individual cables or cable harnesses, are known in a great number of forms.

2. Description of the Related Art

As a representative, reference may be made in this connection for instance to the 2.5 mm family of plug connectors known as SIPAC, made and sold by Siemens. Descriptions of the basic model and of further developments of this electrical connector have been published in "Components", 30 (1992), No. 5, pp. 189–192 and in "Markt und Technik—Wochenzeitung für Elektronik" [Market and Technology—Electronics Weekly] No. 26, Jun. 24, 1994, pp. 36–37.

As may be learned from the above publications, major effort has been devoted recently to making the known electrical connectors HF-compatible.

The need for HF-compatible electrical connectors is steadily increasing. This is because on the one hand the signals to be transmitted via the electrical connectors are increasingly digital signals, whose error-free transmission, because of the steep signal edges they contain, requires a frequency band extending into the HF range even at low transmission rates. On the other hand, the transmission rates demanded are increasing steadily as well and have meanwhile already reached orders of magnitude of GBit/s.

For the reasons given above, the electrical connectors must have reflection, impedance and crosstalk properties that enable distortion and interference-free transmission at even the highest frequencies.

Various attempts have already been made in the past to this end.

For instance, to reduce crosstalk, it is possible for channels to be transmitted to be carried over only every other contact, while the intervening contacts are connected to common ground. However, in such an embodiment, the number of terminals usable for signal transmission is drastically reduced, so that it appears relatively useless for applications with high signal density.

It has become known heretofore from German Patent DE 40 40 551 C2 to prevent crosstalk between adjacent terminals in adjacent vertical rows by inserting a shielding element between the vertical connection rows of a female multipoint connector. A disadvantage of this embodiment, however, is that of the five available rows of contacts, only three rows are usable for signals, since two rows are occupied by ground.

On the other hand, European patent publication EP 0 486 298 A1 discloses a connector configuration in which ground contacts are disposed between signal contacts, each offset by one-half the pitch, so that the signal contacts in the mounted state are surrounded by ground contacts. That configuration is less than ideal in the sense that the individual contacts which connect to ground must all be contacted individually to the printed circuit boards, which makes it considerably more difficult to untangle the signal lines.

From the periodical already mentioned above, "Markt und Technik—Wochenzeitung für Elektronik" [Market and Technology—Electronics Weekly] No 26, Jun. 24, 1994, pp. 36–37, it has become known heretofore to provide continuous shielding of each individual contact with a tight square metal shaft. The "lattice" of lengthwise and crosswise metal plates required for this shaft, which are spaced apart 2.5 mm in the exemplary embodiment described, is disposed entirely inside the female multipoint connector. At the penetration points of the crosswise and lengthwise plates, closely spaced slits must therefore be provided, which mesh with one another and which make high-grade electrical contact with one another; this clearly requires considerable engineering effort and entails high additional costs.

The above-described prior art options for reducing distortion and/or interference in signal transmission have the disadvantage that either a great number of additional ground contacts or complicated shielding of the individual contacts must be provided. This entails considerable added expense in manufacture and/or in the use of the connectors. Aside from this, even in the ways described above, the distortion and/or interference occurring in signal transmission cannot be eliminated entirely, so that the efforts made thus far have not been satisfactory, either financially or technologically.

SUMMARY OF THE INVENTION

It is accordingly an object of the invention to provide an electrical connector, which overcomes the above-mentioned disadvantages of the heretofore-known devices and methods of this general type and which is improved in such a way that distortion and/or interference in signal transmission can be considerably reduced in a simple, less costly, and reliable way.

With the foregoing and other objects in view there is provided, in accordance with the invention, an electrical connector assembly for establishing an electrical contact with contacting devices of external terminals, comprising:

an electrical connector, the electrical connector having contacting devices with contact faces formed thereon; the contact faces having a shape enabling a substantially overlap-free connection thereof with contact faces defined on the contacting devices of the external terminals.

In accordance with an added feature of the invention, the electrical connector is a printed circuit board connector for electrically connecting a first and a second printed circuit board.

In accordance with an additional feature of the invention, the first and second printed circuit boards each have a bottom and a top surface, and the electrical connector includes means which facilitate mounting thereof substantially orthogonally or parallel to at least one of the surfaces.

In accordance with another feature of the invention, the electrical connector is configured for a prevailing current flow through the contact faces of the contacting devices, the contact faces having a length in a first direction greater than a length thereof in a second direction, the first direction being defined perpendicularly to the prevailing current flow, and the second direction being defined parallel to the prevailing current flow.

In accordance with further features of the invention, the contact faces of the contacting devices are substantially flat or they have a curved face segment for facilitating large-area contacting.

In accordance with again an added feature of the invention, the assembly includes elastic elements connected to the contact faces of the contacting devices, the elastic elements, in a connected state of the electrical connector, being deflected out of a position of repose thereof and exerting a contact-pressure force via the contact faces upon the contact faces of the contacting devices of the external terminals. Preferably, the contact-pressure force exerted by each contact face is a force pressing the contact faces of the contacting devices of the respectively associated external terminal away from the electrical connector. The contact-pressure force exerted by each contact face may act on each element in an equal direction away from the electrical connector.

In accordance with again an additional feature of the invention, the contacting devices of the external terminals are substantially flat contact spots on at least one the surfaces of the first and second printed circuit boards.

In accordance with again another feature of the invention, the assembly includes a plurality of connecting devices which, in a connected state of the electrical connector, extend continuously through channels formed in the electrical connector, the connecting devices each extending between and electrically connecting mutually associated contacting devices.

In accordance with again a further feature of the invention, the channels formed in the electrical connector have walls formed of a metal-containing material. The walls are preferably connected to electrical ground.

In accordance with yet an added feature of the invention, the assembly includes guide lugs disposed in the channels for displaceably fixing corresponding segments of the connecting devices in the channels.

In accordance with yet an additional feature of the invention, the assembly includes retainers disposed in the channels for rigidly fixing corresponding segments of the connecting devices in the channels.

In accordance with a concomitant feature of the invention, the walls of the channels include impedance-determining walls, and the connecting devices being fixed in the channels such that, upon a movement of the connecting device occurring when the electrical connector is put in the connected state, a spacing of the connecting device from the impedance-determining wall of the respective channel is kept substantially constant.

In other words, the contact faces provided on the contacting devices of the electrical connector have a shape that enables an essentially overlap-free connection with contact faces of the contacting devices of the external terminals.

Thus when the electrical connector of the invention is used as intended, a transition point is eliminated which is otherwise typically present when conventional electrical connectors are used, and at which the signals to be transmitted are typically reflected.

As a result, the interference and distortion occurring in signal transmission because of reflection are reduced considerably in the connector of the invention.

The interference and distortion caused by reflection can even be eliminated entirely when the electrical connector of the invention is used.

With the electrical connector of the invention it is in fact not only possible to adapt the shape of the contacting devices of the external terminals to suit the intended contacting but also, in accordance with the changed circumstances, to provide a modification of the fastening thereof to the external line. The result is the elimination of yet another source of unwanted reflection in signal transmission.

The sources of reflection that can additionally be eliminated with the invention are those points at which the male or female multipoint connectors in contacting devices were previously pressed into a printed circuit board or the like.

When the electrical connector of the invention is used with its specifically arranged contact faces, it is possible for the contacting devices of the external terminals, until now embodied as male or female multipoint connectors and which after all are provided specifically for the overlapping contacting that the invention seeks to avoid, to be replaced by simple contact spots, for instance in the form of solder eyes on a printed circuit board or the like.

This avoidance of using male and female multipoint connectors as contacting devices means that the press-in points of these connectors acting as transition points are also omitted, and thus the reflection occurring in signal transmission can be reduced to a minimum.

The electrical connector of the invention thus makes it possible for the distortion and/or interference that typically occurs in signal transmission to be reduced considerably in a simple, cost-effective and reliable way.

Other features which are considered as characteristic for the invention are set forth in the appended claims.

Although the invention is illustrated and described herein as embodied in an electrical connector, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
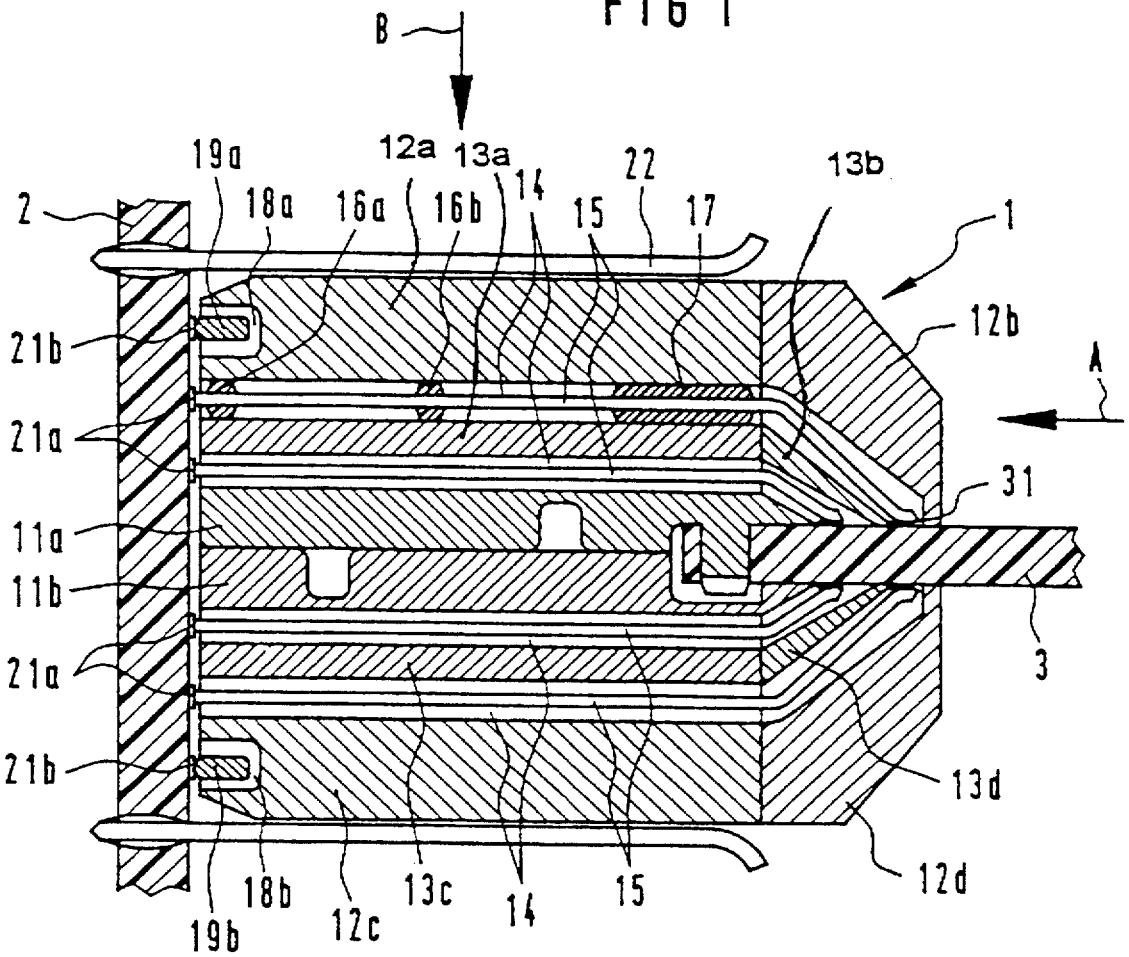
FIG. 1 is a schematic cross-sectional view of an exemplary embodiment of the electrical connector of the invention in the connected state.

Referring now to the figures of the drawing in detail and first, particularly, to FIG. 1 thereof, there is seen an electrical connector 1 which, in the exemplary embodiment described herein, serves as a printed circuit board connector element. The element connects the surface of a backplane printed circuit board 2, or simply backplane, and a module printed circuit board 3, or module board. In the connected state, the module board 3 is mounted on the surface of the backplane 2, with the interposition of the electrical connector 1.

In the connected state, the electrical connector 1 is placed symmetrically around a contacting segment of the module board 3. Each of the symmetrical halves (the upper and lower halves in terms of FIG. 1) has a layered or sandwich structure, i.e. it is stratified.

One symmetrical half, that is, the upper half in FIG. 1, comprises a bottom 11*a* located in the center of the electrical connector 1, a cap located on the outside made up of cap parts 12*a*, 12*b*, and a middle piece, located between the bottom and the cap, made up of middle piece parts 13*a*, 13*b*. The other symmetrical half, that is, the lower half in FIG. 1, comprises a bottom 11*b* located in the center of the electrical connector 1, a cap located on the outside made up of cap parts 12*c*, 12*d*, and a middle piece, located between the bottom and the cap, made up of middle piece parts 13*c*, 13*d*.

On their side toward the backplane 2 in the connected state, the caps have recesses 18*a*, 18*b*, which serve to connect the housing of the electrical connector 1 to a ground terminal of the backplane via spring elements 19*a*, 19*b* or the like.

The middle piece parts 13*a*, 13*b*, 13*c*, 13*d* in this exemplary embodiment have an arbitrary number of labyrinthine recesses for forming channels 14, both on their side toward the cap parts 12*a*, 12*b*, 12*c*, 12*d* and on their side toward the bottom 11*a*, 11*b*.

Connecting devices 15, to be described in further detail hereinafter, for electrical contacting and connection of the backplane and module boards extend within these channels 14.

A total of four channels with four connecting devices 15 are shown in FIG. 1. The inner two channels and connecting devices (i.e., "inner" in terms of FIG. 1) are not located exactly above and below the outer channels and connecting devices in FIG. 1. Instead, as can be seen from the staggered arrangement of channels and connecting devices shown in FIG. 2, FIG. 1 is a sectional view extending through different planes.

In the view shown in FIG. 1, the channels 14 having the connecting devices 15 extend initially substantially at right angles away from the backplane 2 and then bend in the direction toward the module board 3.

For further explanation of the layout, arrangement and function of the middle piece parts 13*a*, 13*b*, 13*c*, 13*d*, channels 14, and connecting devices 15, reference will now be made to FIGS. 2A–2C and to FIG. 3.

Figure 2A:
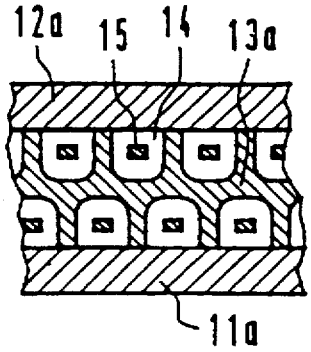
FIG. 2A is a partial, schematic sectional view of the upper symmetrical half of FIG. 1, of the electrical connector, as seen from a direction represented by an arrow A in FIG. 1.

FIG. 2A shows a sectional view of the upper symmetrical half, in terms of FIG. 1, of the electrical connector from a direction represented by an arrow A in FIG. 1.

FIG. 2A clearly shows how in the completely assembled connector, the channels 14, corresponding to the labyrinthine recesses of the middle part 13*a*, for guiding the connecting devices 15 are formed by placing the bottom 11*a*, middle piece part 13*a* and cap part 12*a* on top of one another.

The top row of channels and connecting devices in terms of FIGS. 1 and 2 is laterally offset relative to the lower row; however, should this prove favorable, they may also be provided without any lateral offset.

In the exemplary embodiment shown in FIG. 2A, the channels are formed by placing a bottom and a cap underneath and on top, respectively, of a middle piece (13*a*) in which recesses corresponding exactly to the channels are provided; the faces of the bottom and the cap toward the middle piece are flat.

Still other options are also conceivable, however, for forming the channels 14 in the electrical connector. Two of these possibilities are shown in FIGS. 2B and 2C.

Figure 2B:
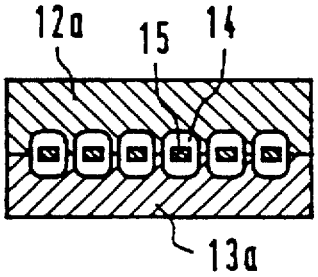
FIG. 2B is a similar view corresponding essentially to that of FIG. 2*a* for a modified embodiment.
Figure 2C:
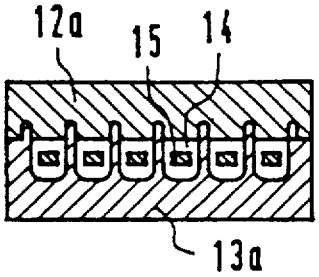
FIG. 2C is a similar view of a further modified embodiment.

FIGS. 2B and 2C show two views corresponding to FIG. 2A, but in which only the cap and the portion of the middle piece adjacent to it are shown in fragmentary form.

In FIG. 2B, both the middle piece part 13*a* and the cap part 12*a* are provided with recesses on their sides facing one another. To form a channel 14, the middle piece part and the cap part must be put together in such a way that the respective recesses in the two parts come to rest one above the other.

The possibility for channel formation shown in FIG. 2B has the advantage that the middle piece part, with the same stability, can be made thinner, or if its thickness remains the same can be made more stable, and moreover is easier to make because the recesses are not as deep.

In FIG. 2C, only the middle piece part 13*a* again has recesses, while conversely the cap part 12*a* has protrusions that protrude into the recesses in the assembled state of the electrical connector.

The possibility of channel formation shown in FIG. 2C has the advantage that assembly of the electrical connector is easier and the attainable precision can be increased.

Figure 3:
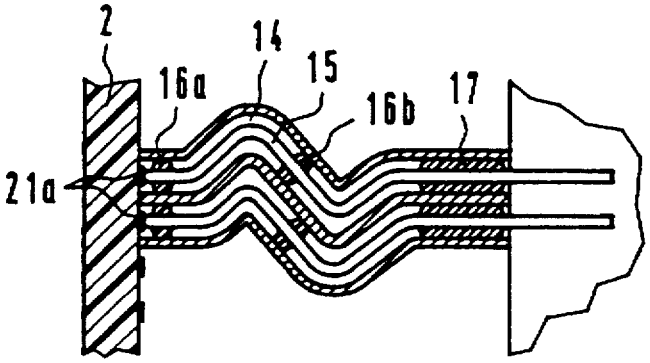
FIG. 3 is a schematic sectional view of the electrical connector seen from a direction represented by an arrow B in FIG. 1.

FIG. 3 shows a sectional view of the electrical connector from a direction represented by an arrow B in FIG. 1. The plane of the section extends along the uppermost of the connecting devices 15 shown in FIG. 1.

It can be seen from FIG. 3 that the channels 14 and the connecting devices 15 guided in them have a serpentine course in the plane shown in the region between the end of the electrical connector toward the backplane 2 and the aforementioned bending point, shown in FIG. 1, of the connecting device.

Each of the connecting devices 15 is fixed in the channels 14 by means of two guide lugs 16*a*, 16*b* and one retainer 17. While these components are not shown everywhere in FIGS. 1 and 3, they are preferably provided for each connecting device.

The retainer 17 assures that the connecting device 15 will be fixed or clamped rigidly in the channel 14 on its right-hand end (FIGS. 1 and 3).

The guide lugs 16*a*, 16*b*, together with the serpentine configuration of the channels 14 and of the connecting devices 15 in this region, and also the fact that here the connecting device 15 is embodied as an elastic spring element make it possible for the connecting devices 15, on their left-hand end (FIGS. 1 and 3) and in the state where the electrical connector is not connected to the backplane 2, to be pressed elastically out of the connector 1 by a slight distance, such as about 1 mm, while in the state where the electrical connector is connected to the backplane 2 they are pressed into the connector, as can be seen from FIGS. 1 and 3. In this latter state, the connecting device 15 exerts a contact-pressure force acting essentially frontally on the backplane, which as will be described in further detail hereinafter is considerably significant with regard to the reliability of the contacting to be brought about.

The guide lugs 16*a*, 16*b* and the retainer 17 are each formed on the connecting devices 15 by spray-coating, by injection, or by other molding.

The connecting devices 15 serve to make an electrical connection between contacting devices of the backplane and the module board. Hence on the one hand, the connecting devices are good electrical conductors, and on the other they are each embodied on their ends with a contact face, enabling electrical contacting, these faces acting as contacting devices.

As can be seen from FIGS. 1 and 3, the backplane 2 has contact points or contact spots 21*a* and 21*b* on its surface as contacting devices, which for the sake of improved contact-making are preferably gold-plated. The contact spots 21*a* are contacting devices for the transmission or exchange of useful signals, while conversely the contact spots 21*b* are contacting devices for grounding the cap parts 12*a* and 12*c* and thus for grounding the entire connector housing.

The electrical connection of the backplane 2 to the electrical connector 1 is brought about by pressing the contacting devices of the electrical connector against the contact spots 21*a* of the backplane.

At the same time, the electrical connection between the cap of the electrical connector and the contact spots 21*b* of the backplane acting as ground terminals is also closed.

The backplane 2 has aids in the form of guiding and reinforcing walls 22, which are preferably made of metal.

These guiding and reinforcing walls 22 have the function on the one hand of guiding the electrical connector 1 when it is pressed against the backplane in such a way that the ends of the connecting devices 15 of the electrical connector that serve as contacting devices precisely meet the contact spots 21*a* acting as contacting devices of the backplane, or—in the connected state—maintain this position and exert an elastic contact-pressure force against them precisely.

On the other hand, these guiding and reinforcing walls have the function of lending greater rigidity to the backplane, so that it will not be excessively bent and thereby damaged when the electrical connector is inserted and pulled out.

The backplane may have bulwark-like bumps, not shown in the drawings, around the contact spots 21*a*, 21*b*. These bulbs are made of dielectric material, preferably by spray-coating with plastic, and serve to guide the contact faces of the contacting devices of the electrical connector exactly to the contact faces of the contacting devices of the backplane and durably keep them in this position, or detent position, accurately defined by the bump. Thus even if nonprecision printed circuit boards and/or electrical connectors are used, safe and secure electrical contact can always be obtained.

The above explanation pertaining to the specific configuration of the contact spots 21*a* and the attendant advantages in making the connection, apply correspondingly to the contact spots 21*b* of the backplane acting as ground contacts.

As can be seen from FIG. 1, the module board 3 has solder points 31, located on both its top and its bottom sides, as its contacting devices.

The electrical connection of the module board 3 with the electrical connector 1 is accomplished in this exemplary embodiment by soldering the contacting devices of the electrical connector to the solder points 31 of the module board 3.

The procedure in making the connection between the backplane 2 and the module board 3 by means of the electrical connector 1, and the advantages of this type of connection, will now be described in detail.

Before the connection is made between the printed circuit boards, the electrical connector 1 is not yet fully put together. At that time, the cap parts 12*b*, 12*d* toward the module board and the corresponding middle piece parts 13*b*, 13*d* are not yet mounted.

In this state (FIG. 1), the end of the module board 3 is inserted into a recess in the bottom 11*a*, 11*b* of the electrical connector 1.

The contacting devices of the electrical connector 1 provided for connection to the module board 3 are soldered to the solder points 31 acting as contacting devices for the module board. The soldering is done in the present exemplary embodiment by the SMT process.

Both during and after the soldering, the as yet unmounted middle piece parts 13*b*, 13*d* and cap parts 12*b*, 12*d* of the electrical connector are inserted in succession and firmly joined to one another and to the module board 3, so as to extend the channels 14 for guiding the connecting devices 15 as far as the module board 3.

In this way, as shown in FIG. 1, the channels 14 extending continuously from the surface of the backplane 2 to the surface of the module board 3 are created for receiving the connecting devices 15.

In the event that the elements of the electrical connector which have yet to be mounted when the electrical connector is contacted with the module board 3 are plastic parts or parts that contain plastic, then the connection can be made by pressing the parts together and pressing them onto the module board 3.

Once the electrical connection has been made between the electrical connector 1 and the module board 3, the electrical connector 1, for electrically connecting with the backplane 2, is slipped onto the backplane 2 along the guiding and reinforcing walls 22 thereof and it is secured there by means of non-illustrated screw bolts.

When the electrical connector 1 is slipped onto the backplane 2, the electrical connectors of the electrical connector 1 provided for connection to the backplane 2 are still pressed out of the electrical connector by the spring force of the connecting devices 15. As mounting continues or by tightening of the screw bolts, the contacting devices of the electrical connector come into contact with the contact spots 21*a* of the backplane 2. By continued mounting or tightening of the screw bolts, from this moment on, the portion of the contacting devices of the electrical connector that protrudes from the electrical connector is pressed back into the channel 14 of the electrical connector 1 by the spring force of the connecting device 15. As a result, a durable frontal contact pressure is exerted by the contacting devices of the electrical connector on the contact spots of the backplane.

At the same time as contact is made between the connecting devices 15 and the contact spots 21*a* acting as useful signal contacts, a contact is made via the spring elements 19*a*, 19*b* between the housing of the electrical connector and the contact spots 21*b* acting as ground contacts; safe and secure contacting in the connected state is effected once again here by a durable frontal contact pressure of the spring elements 19*a*, 19*b*, acting as contacting devices of the electrical connector 1, on the corresponding contact spots 21*b* of the backplane.

The contact-pressure forces acting in the connected state of the electrical connector between the respective contacting devices of the backplane 2 and of the electrical connector 1 assure a firm, reliable contacting in an extremely simple way.

The described contacting mode has decisive advantages over conventional contacting modes.

The contacting described here is in fact done entirely without transition points, with the attendant boundary surfaces. These transition points in conventional electrical connectors are formed by the contact overlap, provided in the connecting path direction, of male and female contacts and by the pressing of the male and female contact strips into the printed circuit boards.

The contact overlap regularly provided in the prior art is avoided in the present invention, or at least reduced to a negligible amount.

The avoidance of contact overlapping results in the elimination of a transition point, and the attendant boundary conditions, at which in conventional electrical connectors the signals to be transmitted are reflected.

The form and orientation of the contact faces of the contacting devices of the electrical connector that bring about the contacting, which form an alignment are altered according to the invention to avoid the contact overlapping, make it easy for the previously used male and female connectors used as contacting devices for the external terminals to be replaced with contacting devices adapted to the changed circumstances, because after all the male and female connectors a redesigned for the overlapping contacting that is now to be avoided.

Replacing the male and female connectors by contact faces as described above not only creates the prerequisites for optimal use of the electrical connector of the invention, but moreover has the considerable advantage that from now on, the points where the male or female connectors are pressed in and which act as reflection sources can be omitted.

The interference and/or distortion in signal transmission caused by reflection can be thus reduced to a minimum by the electrical connector described. A further substantial advantage of the above-described electrical connector is that the connecting devices are guided over the entire path from the backplane to the module board in channels that are closed on all sides. If a metal or metal-coated materials or metal-containing materials, such as metallized plastics or in other words plastics with metal inlays, are now used as the material for the housing parts of the electrical connector, that is, for the bottoms, middle pieces and caps, and if these materials—as done here—are connected to ground, then the connecting devices 15 are guided in shielded tunnels in a manner similar to a coaxial line.

Crosstalk-caused interference and/or distortion in the signal transmission is reduced to a minimum by these provisions.

Guiding the connecting devices in channels whose walls contain grounded metal also opens up a simple way of being able to influence the impedance of the electrical connector.

A given impedance can in fact be set by setting a precise spacing between the connecting device and at least one side wall of the channel.

At points where the elastically embodied connecting devices are deflected, in the connected state, out of their position of repose, however, for the sake of embodying the contacting safely and reliably by means of a contact-pressure force acting on the contact faces, care must be taken to assure that the connecting device moves in a plane that extends parallel to the impedance-determining wall.

Adhering to the desired spacing from the impedance-determining wall of the applicable channel can be achieved by means of a suitable embodiment of the course of the channel and/or a suitable embodiment and positioning of the guide lugs and/or retainers that fix the connecting devices in the channels.

If this care is taken, then interference and/or distortion in signal transmission resulting from an unsuitable impedance or from fluctuations in impedance are reduced to a minimum.

The reduction in interference and/or distortion in signal transmission, attained by the present invention, is achieved without sacrificing safety and reliability.

The frontal pressing together of the contact faces to be contacted, effected by the elastic spring force of the connecting device of the electrical connector, makes for connecting properties that are in no way inferior to those of conventional connectors.

The above-described provisions, both individually and in combination, make it possible in an extremely simple way to reduce the interference and/or distortion occurring in signal transmission with conventional electrical connectors to a minimum.

The invention has been described above in terms of one very specific exemplary embodiment.

However, many modifications are conceivable that can advantageously further develop this exemplary embodiment.

Some of them will briefly be described below in closing.

In the above-described exemplary embodiment, the contacting devices of the electrical connector and of the module board were contacted by soldering. Instead of soldering, however, a connection that corresponds substantially to the connection between the electrical connector and the backplane can be used.

For that purpose, provision would have to be made to embody the connecting device of the electrical connector as a resilient element on the side toward the module board as well; when the electrical connector is put in the connected state from its position of repose, this resilient element is deflected and in the connected state exerts a contact-pressure force on the contacting point of the module board.

For purposes of explanation, reference will now be made to FIG. 4.

Figure 4:
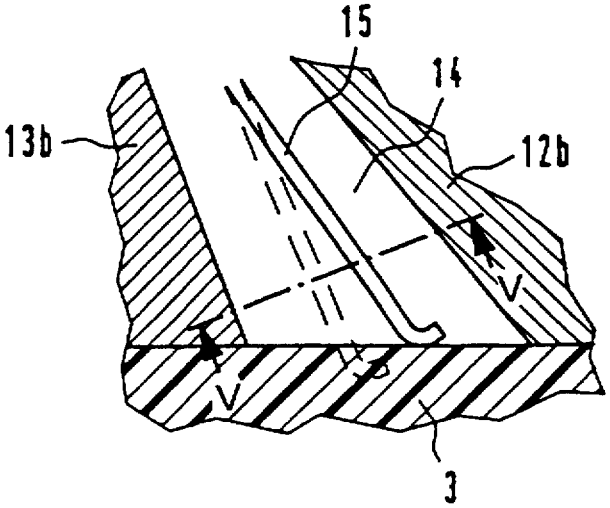
FIG. 4 is a schematic sectional view of the connection of a modified electrical connector with a printed circuit board to be contacted.

FIG. 4 shows a view corresponding to FIG. 1, but showing only the modified contacting region in question between the electrical connector and the module board.

FIG. 4 shows the connected state between the electrical connector 1 and the module board 3. In this state, the connecting device is deflected out of the position of repose represented by dashed lines in the drawing and exerts a contact-pressure force on the module board.

In the position of repose, the connecting device 15 protrudes from the surface of the electrical connector toward the module board 3. Upon connection, the connecting device 15 is pressed back into the channel 14 counter to the spring force of the electrical connector.

The motion of the connecting device occurring relative to the walls of the channel is advantageously designed such that the spacing between the connecting device 15 and the impedance-determining wall of the channel remains constant.

Figure 5A:
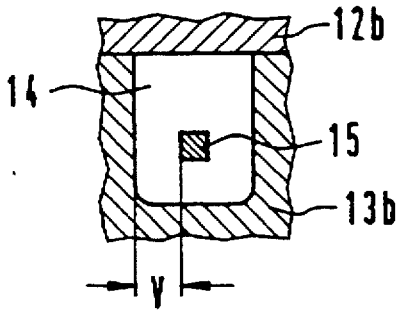
FIG. 5A is a schematic illustration of the positions of a connecting device in a channel in the disconnected state of the electrical connector.
Figure 5B:
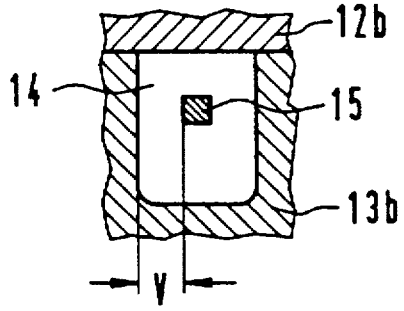
FIG. 5B is a similar view of the positions of a connecting device in the channel in the connected state of the electrical connector.

This is illustrated in FIGS. 5A and 5B.

FIGS. 5A and 5B are sectional views of the electrical connector, seen in the direction of the arrows in FIG. 4.

FIG. 5A shows the electrical connector in the state in which it is not connected to the module board. FIG. 5B shows the electrical connector in the state connected to the module board.

As can be seen in FIGS. 5A and 5B, the connecting device 15 assumes different positions inside the channel in the various states.

However, these different positions are chosen such that the spacing of the connecting device 15 from the impedance-determining wall of the channel, which in the present exemplary embodiment is the left-hand wall of the channel in terms of FIGS. 5A and 5B, remains constant (in the exemplary embodiment shown, constant is equal to v) when the connecting device changes positions within the channel.

This kind of defined motion of the connecting device inside the channel has the advantage that even if, because of contacting devices that have not been processed exactly identically, the connecting device on being put in the connected state is displaced variously far inside the channel, still precisely the desired impedance can be adhered to at all times for all the connecting devices. Moreover, a desired impedance of the electrical connector can be established extremely simply and even before installation.

The above embodiments of the electrical plug all refer to the transmission of asymmetrical signals, that is, the transmission of the signals via an inner conductor in the form of the connecting device and an outer conductor in the form of the electrically conductive channel walls.

However, the electrical connector of the invention can also be designed to transmit symmetrical signals. In this case, two parallel inner conductors per channel should be provided, in the form of two parallel-extending connecting devices.

The provision of two connecting devices extending parallel in the channel requires a different setting and adherence to the impedance value. In this case, the impedance value is the result of the spacing between the two connecting devices and the spacings between the conductors and the channel walls.

Regardless of contacting mode chosen, all the above remarks about setting and adhering to the impedance are applicable to all embodiments in which a connecting device is guided in a channel that allows the free positioning of that device.

Another advantageous further development of the invention relates to the modification of the connection of the electrical connector to ground.

Figure 6A:
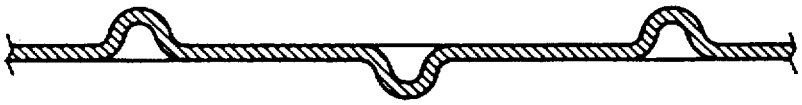
FIG. 6A is a sectional view of a contact strip in the noncontacted state.
Figure 6B:
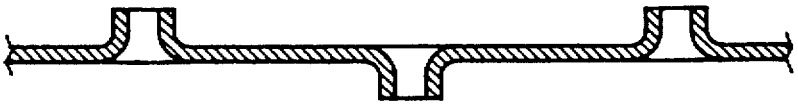
FIG. 6B is a similar view of another embodiment of a contact strip in the noncontacted state.
Figure 6C:
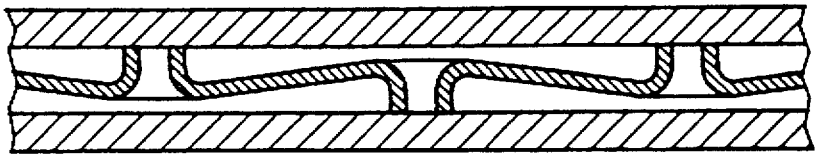
FIG. 6C is a similar view of the contact strip of FIG. 6B, in a condition in which it is fastened between two faces that are to be contacted.

Instead of connecting the housing to the contact spot **21*b* shown in FIG. 1 and acting as a ground terminal, a contact strip as shown in FIGS. 6A–6C** can be used, which is inserted between the points or faces to be contacted.

FIGS. 6A and 6B show different embodiments of the contact strip in the position of repose and in the connection-free state, respectively, while conversely FIG. 6C shows the contact strip of FIG. 6B in a state in which it is fastened between two faces to be contacted.

A common feature of the embodiments of the contact strip of FIGS. 6A and 6B is that they have high-density wavelike deformations with resilient properties, which in the pressed-together state have the tendency to return to their position of repose again.

As seen particularly in FIG. 6C, when the contact strip is compressed the result between the faces to be contacted is many contact points on which contact pressure is elastically exerted and which enable good, reliable contacting.

If one imagines the contact strip as annularly surrounding each of the channels, then this accordingly prevents the occurrence of crosstalk at that point, and the interference and/or distortion occurring in signal transmission can thus be still further reduced.

A further modification of the invention relates to the generation of the force that presses the contact faces to be contacted against one another in the connected state.

In the embodiments described above, the assumption was always that this force is generated by the various connecting devices themselves.

Instead, or in addition, however, it may also be provided that the force be exerted by the various contacting devices of the external terminals or by auxiliary elements disposed at some arbitrary point.

Because of the maximal elimination of the interference and/or distortion caused by reflection, crosstalk and damping, the electrical connector described is fully HF-compatible and nevertheless is extremely simple and inexpensive to make and mount.

We claim:

1. An electrical connector assembly for establishing an electrical contact with contacting devices of external terminals, comprising:

an electrical connector, said electrical connector having channels formed therein and said channels each having an end;

connecting devices each having an elastic element and contact faces formed thereon being disposed in said channels;

said contact faces having a shape enabling a substantially overlap-free connection thereof with contact faces defined on the contacting devices of the external terminals;

said connecting devices protruding beyond said end of said channels when said electrical connector is not engaging the external terminals;

said connecting devices being deflected out of a position of repose and back into said channels and exerting a contact pressure force via said contact faces upon the contact faces of the contacting devices of the external terminals when said electrical connector engages the external terminals;

said channels each having impedance-determining walls, and said connecting devices being fixed in said channels such that a spacing of said contacting devices from said impedance-determining walls of said channels is kept substantially constant at all times such that the connecting devices do not touch said walls.

2. The assembly according to claim 1, wherein said electrical connector is a printed circuit board connector for electrically connecting the external terminals of a first and a second printed circuit board.

3. The assembly according to claim 2, wherein the first and second printed circuit boards each have a bottom and a top surface, and said electrical connector includes means which facilitate mounting thereof substantially perpendicularly to at least one of the surfaces.

4. The assembly according to claim 2, wherein the first and second printed circuit boards each have a bottom and a top surface, and said electrical connector includes means which facilitate mounting thereof substantially parallel to at least one of the surfaces.

5. The assembly according to claim 1, wherein said contact faces having a length in a first direction greater than a length thereof in a second direction, said first direction being defined perpendicularly to said contacting devices, and said second direction being defined parallel to said contacting devices.

6. The assembly according to claim 5, wherein said contact faces of said contacting devices are substantially flat for facilitating large-area contacting.

7. The assembly according to claim 5, wherein said contact faces of said contacting devices have a curved face segment facilitating large-area contacting.

8. The assembly according to claim 1, wherein the contact-pressure force exerted by each contact face is a force pressing the contact faces of the contacting devices of the respectively associated external terminal away from said electrical connector.

9. The assembly according to claim 1, wherein the contact-pressure force exerted by each contact face is a force pressing the contact faces of the contacting devices of the associated external terminals substantially in an equal direction away from said electrical connector.

10. The assembly according to claim 2, wherein the contacting devices of the external terminals are substantially flat contact spots on at least one of the surfaces of the first and second printed circuit boards.

11. The assembly according to claim 1, wherein said walls of said channels formed in said electrical connector are formed of a metal-containing material.

12. The assembly according to claim 11, wherein said walls of said channels are electrically connected to ground.

13. The assembly according to claim 1 which further comprises guide lugs disposed in said channels for displaceably fixing corresponding segments of said connecting devices in said channels.

14. The assembly according to claim 13, which further comprises retainers disposed in said channels for rigidly fixing corresponding segments of said connecting devices in said channels.

15. The assembly according to claim 1, which further comprises retainers disposed in said channels for rigidly fixing corresponding segments of said connecting devices in said channels.

* * * * *